US007942476B2

(12) United States Patent
Chen

(10) Patent No.: US 7,942,476 B2
(45) Date of Patent: May 17, 2011

(54) COLLAPSIBLE CHAIR

(76) Inventor: Kao-San Chen, Tainan (TW)

( * ) Notice: Subject to any disclaimer, the term of this patent is extended or adjusted under 35 U.S.C. 154(b) by 68 days.

(21) Appl. No.: 12/473,690

(22) Filed: May 28, 2009

(65) Prior Publication Data

US 2009/0230735 A1 Sep. 17, 2009

Related U.S. Application Data

(63) Continuation-in-part of application No. 12/006,374, filed on Jan. 3, 2008, now abandoned.

(51) Int. Cl.
*A47C 4/48* (2006.01)

(52) U.S. Cl. ..... 297/42; 297/16.2; 297/44

(58) Field of Classification Search ..... 297/16.2, 297/42
See application file for complete search history.

(56) References Cited

U.S. PATENT DOCUMENTS 6,082,813 A * 7/2000 Chen ..... 297/16.2 X
6,302,479 B1 * 10/2001 Zheng ..... 297/16.2
6,454,348 B1 * 9/2002 Wu ..... 297/16.2
7,070,230 B2 * 7/2006 Chen ..... 297/16.2 X
7,334,837 B1 * 2/2008 Long ..... 297/16.2

* cited by examiner

*Primary Examiner* — Anthony D Barfield

(57) ABSTRACT

A collapsible chair frame includes two rear legs and two front legs. A cap is secured to a lower end of each leg. A sheath extends from each cap and continues to receive the related leg when the related cap is lowered beyond the related leg in a collapsed position of the collapsible chair frame. A lower ring is movably provided on each leg. A rear, upper ring is secured to each rear leg. A front, upper ring is movably provided on each front leg. A lateral rod includes a lower end pivotally connected to each lower ring and an upper end pivotally connected to each upper ring. A rear rod, longer than the lateral rods, connects a related cap to a related rear, upper ring. A front rod, as long as the rear rods, connects a related cap to a related front, upper ring.

2 Claims, 7 Drawing Sheets

COLLAPSIBLE CHAIR

CROSS-REFERENCE

The present application is a continuation-in-part application of U.S. patent application Ser. No. 12/006,374 filed Jan. 3, 2008 now abandoned, of which the entire disclosure is incorporated herein.

BACKGROUND OF THE INVENTION

1. Field of Invention

The present invention relates to a chair and, more particularly, to a collapsible chair.

2. Related Prior Art

As disclosed in U.S. Pat. No. 6,082,813 for example, a conventional collapsible chair frame includes two front legs 21, two rear legs 22 and stretchers 41 for pivotally connecting the legs 21 and 22 to one another. This conventional collapsible chair frame can smoothly be switched between an extended position and a collapsed position. However, this conventional collapsible chair frame is not ergonomic since the width of the collapsible chair frame in a front view is identical to the width of the collapsible chair frame in a side view.

Another conventional collapsible chair frame is disclosed in U.S. Pat. No. 7,070,230. It is not clearly pointed out whether the width of the collapsible chair frame in a front view is larger than the width of the collapsible chair frame in a side view for ergonomic reasons.

The present invention is therefore intended to obviate or at least alleviate the problems encountered in prior art.

SUMMARY OF THE INVENTION

It is the primary objective of the present invention to provide an ergonomic collapsible chair frame.

According to the present invention, the collapsible chair frame includes two rear legs and two front legs. A cap is secured to a lower end of each of the legs. A sheath is extended from each of the caps and used to continue to receive the related leg when the related cap is lowered beyond the related leg in a collapsed position of the collapsible chair frame. A lower ring is movably provided on each of the legs. A rear, upper ring is secured to each of the rear legs. A front, upper ring is movably provided on each of the front legs. A lateral rod includes a lower end pivotally connected to each of the lower rings and an upper end pivotally connected to each of the upper rings. There are two rear rods extending longer than the lateral rods. Each of the rear rods includes a lower end pivotally connected to a related one of the caps and an upper end pivotally connected to a related one of the rear, upper rings. There are two front rods extending as long as the rear rods. Each of the front rods includes a lower end pivotally connected to a related one of the caps and an upper end pivotally connected to a related one of the front, upper rings.

Other objectives, advantages and features of the present invention will become apparent from the following description referring to the attached drawings.

BRIEF DESCRIPTION OF THE DRAWINGS

The present invention will be described via detailed illustration of three embodiments referring to the drawings.

DETAILED DESCRIPTION OF THE EMBODIMENTS

Figure 1:
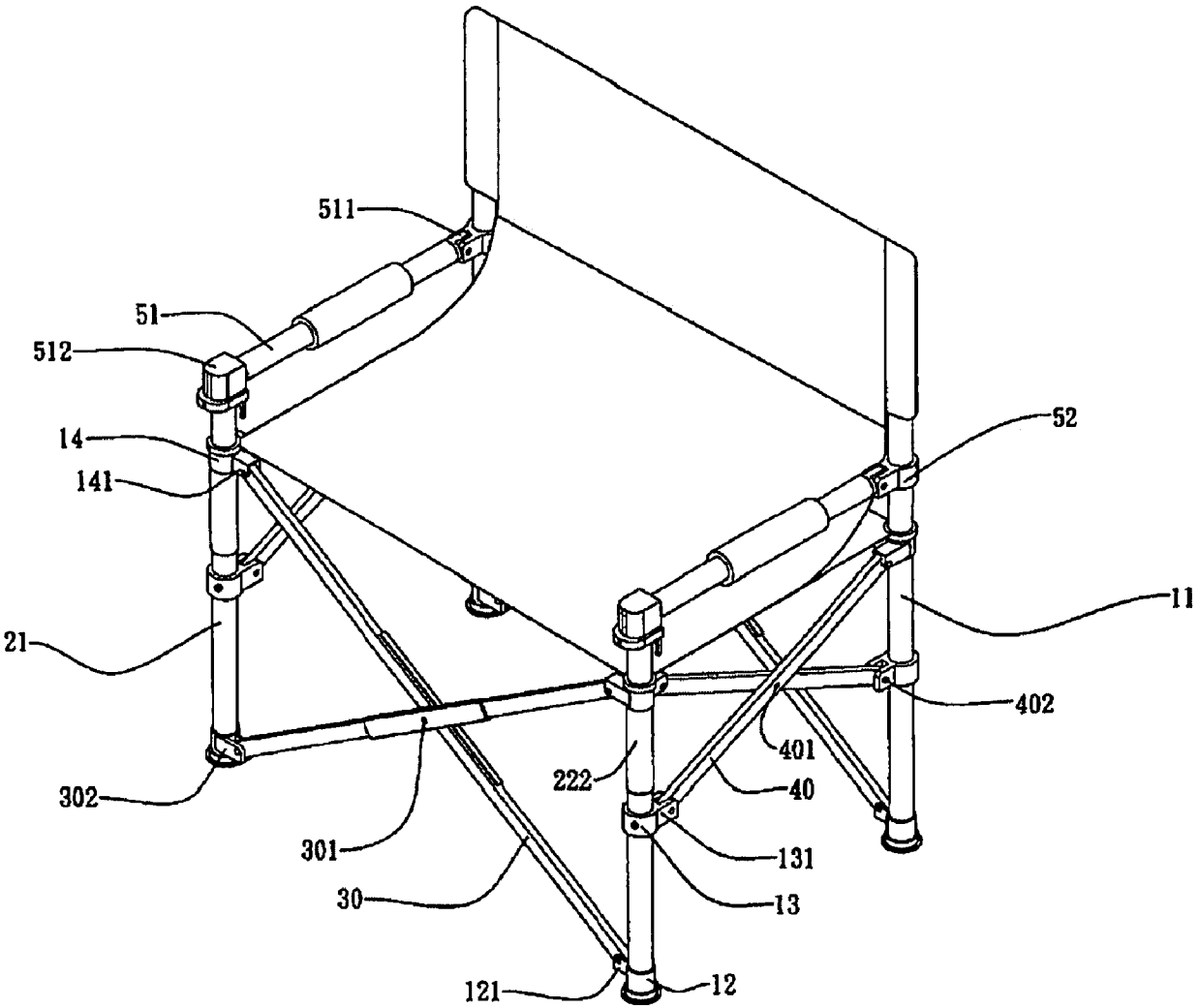
FIG. 1 is a perspective view of a collapsible chair according to the first embodiment of the present invention.
Figure 2:
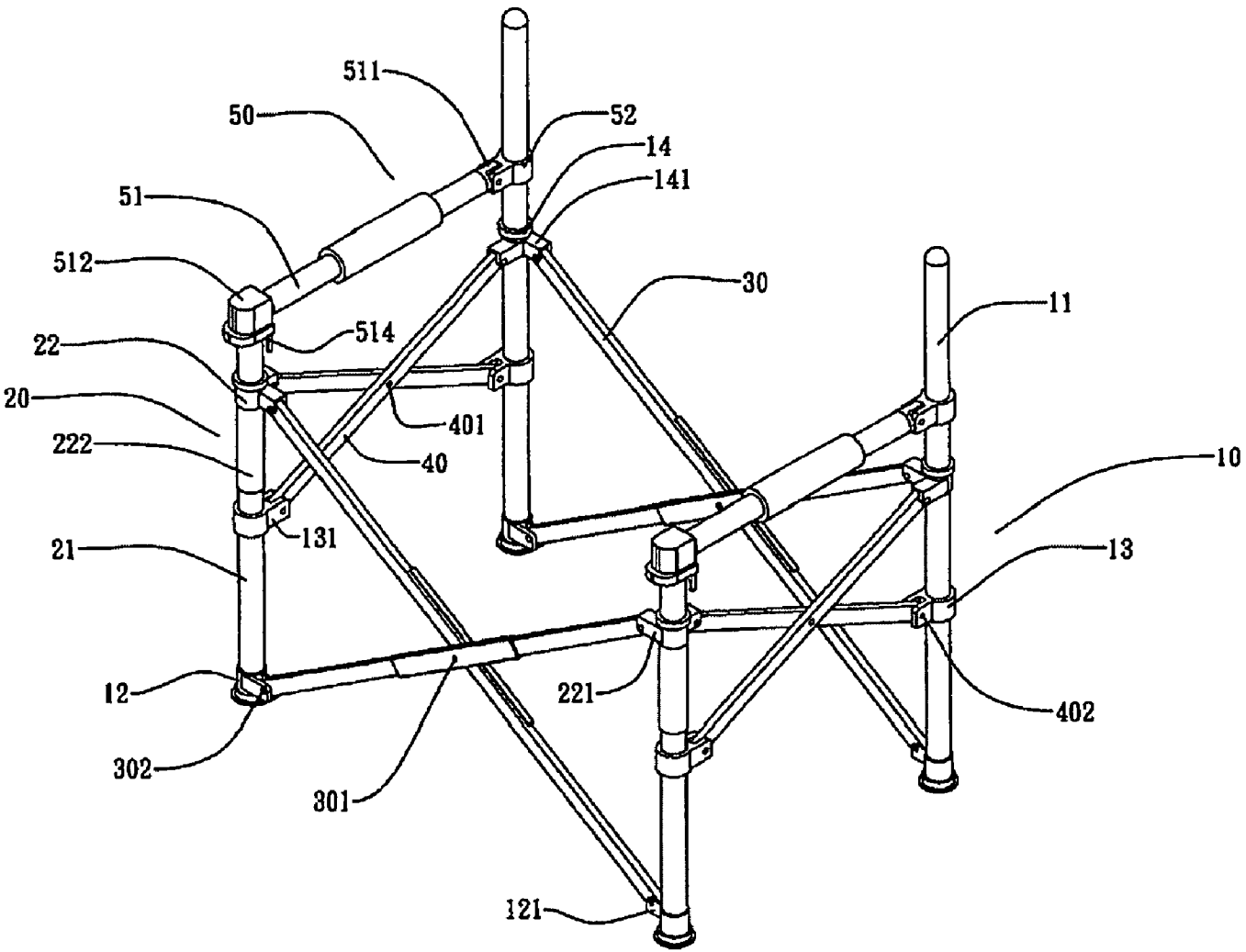
FIG. 2 is a perspective view of a collapsible chair frame of the collapsible chair shown in FIG. 1.
Figure 3:
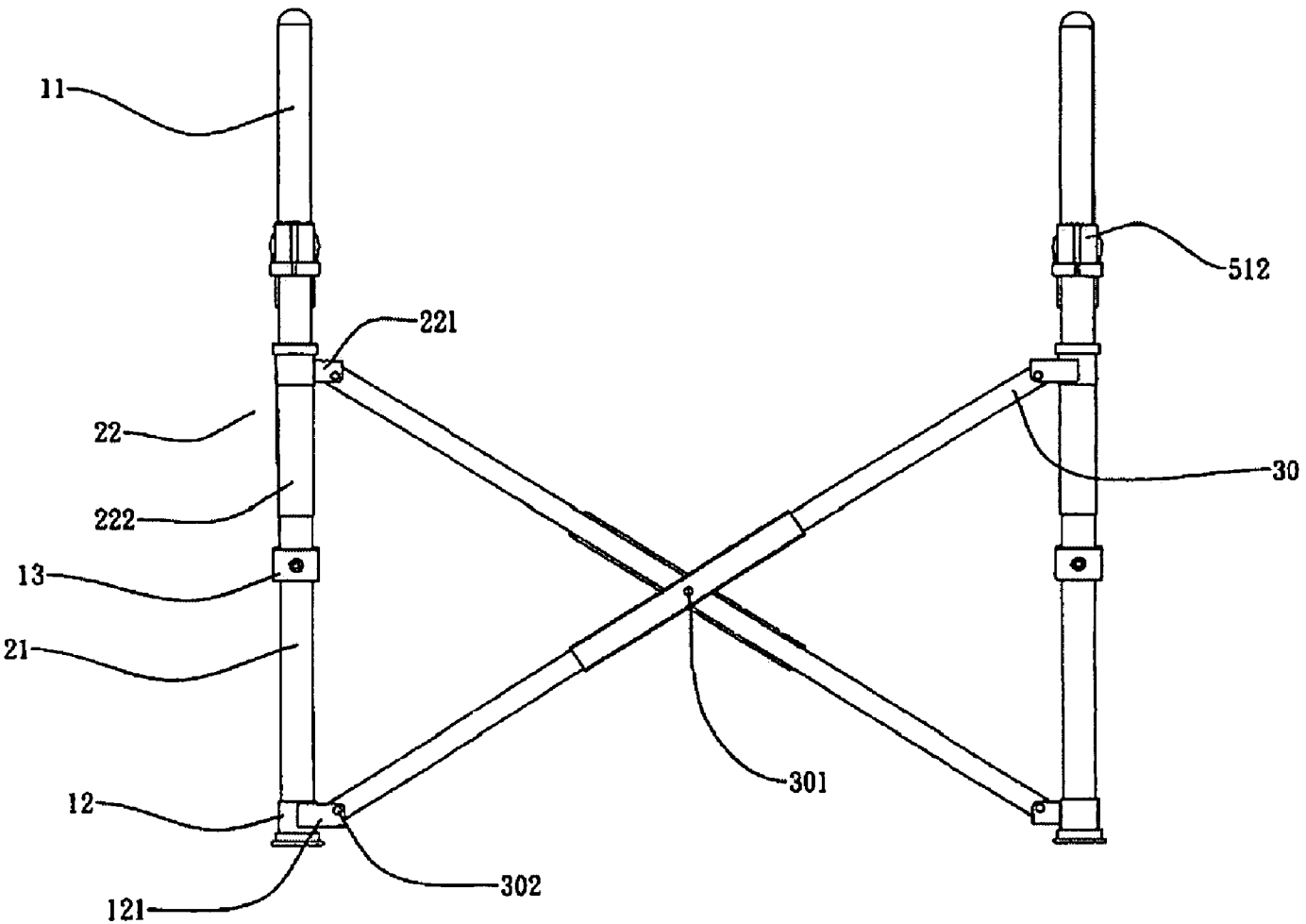
FIG. 3 is a front view of the collapsible chair frame shown in FIG. 2.
Figure 4:
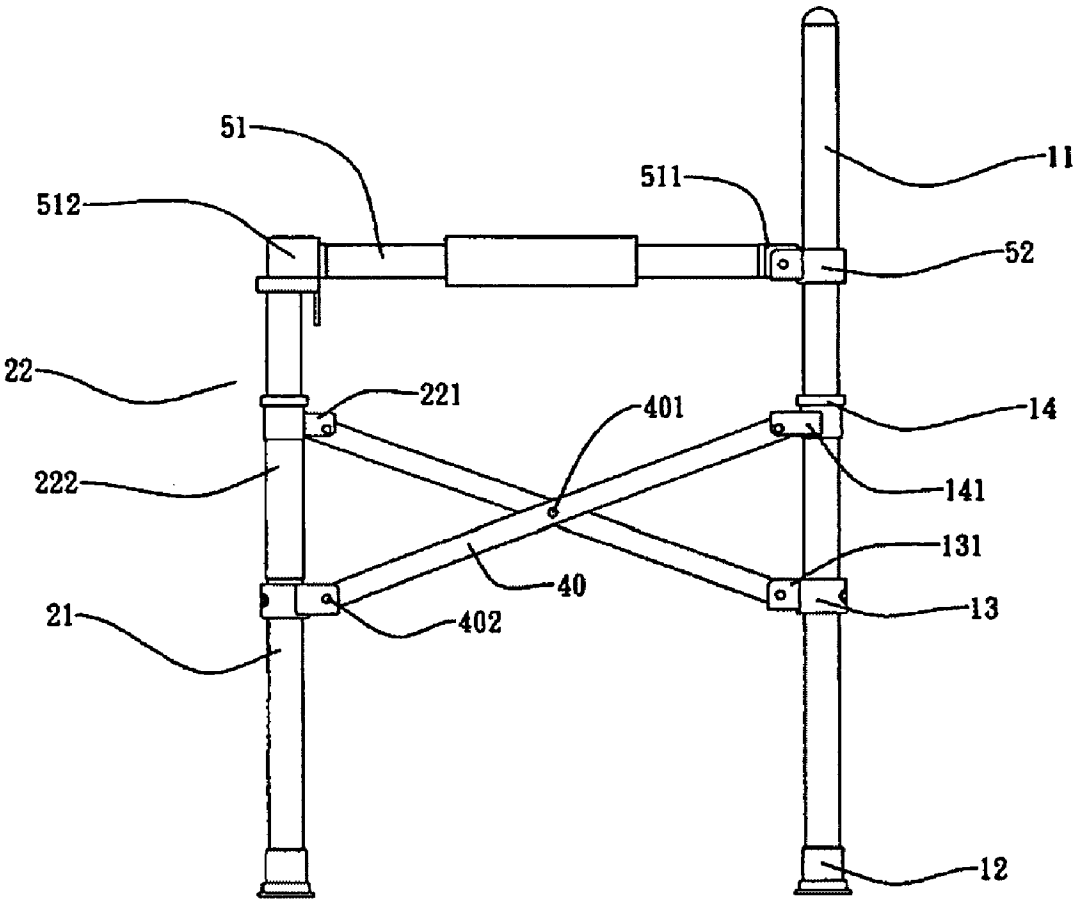
FIG. 4 is a side view of the collapsible chair frame shown in FIG. 3.
Figure 5:
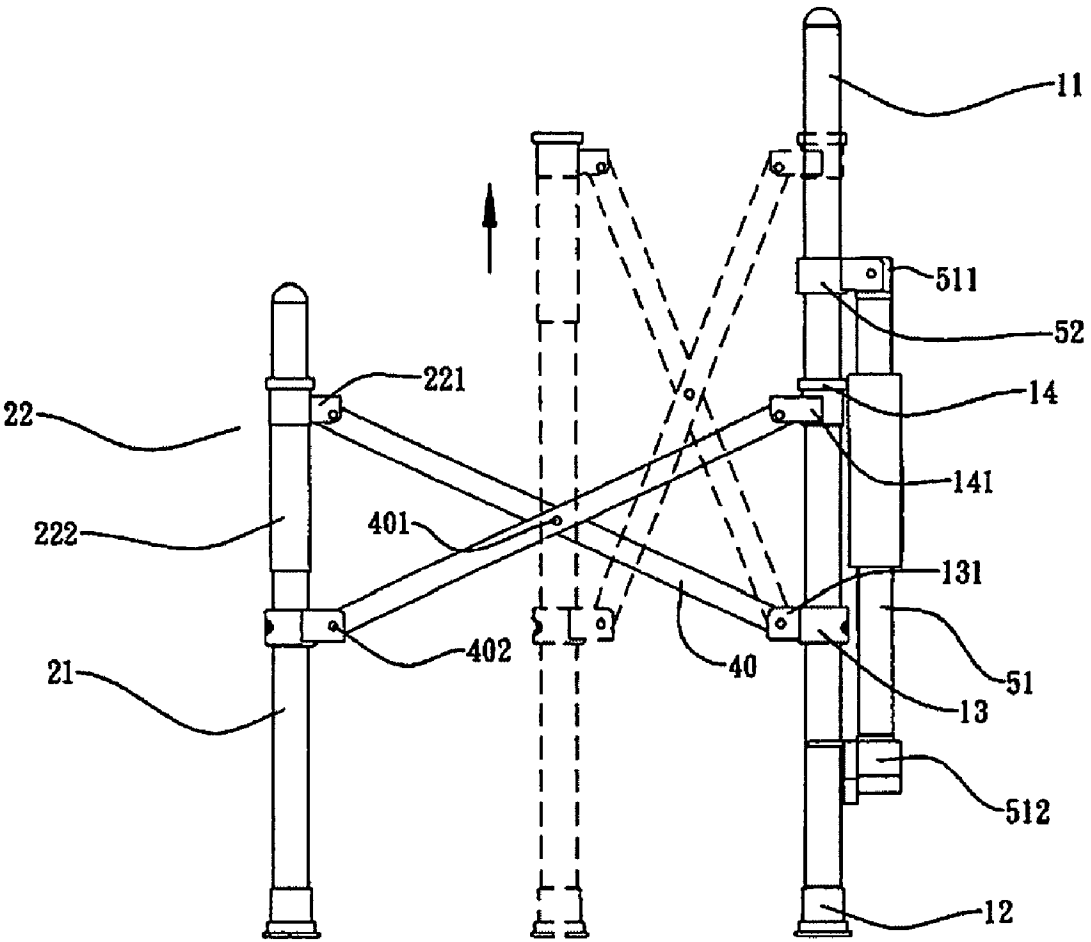
FIG. 5 is a side view of the collapsible chair frame in another position than shown in FIG. 4.

Referring to FIGS. 1 to 5, a collapsible chair includes a mat supported on a collapsible chair frame according to a first embodiment of the present invention. The mat is used as a seat and a backrest. The collapsible chair frame includes a rear leg unit 10, a front leg rod unit 20, a front linking unit, a rear linking unit, two lateral linking units and an armrest unit 50.

The rear leg rod unit 10 includes two rear legs 11, two caps 12, two lower rings 13 and two upper rings 14. The rear legs 11 are in the form of a cylinder. Each of the caps 12 receives and is secured to a lower end of a related one of the rear legs 11. Each of the caps 12 is formed with a bracket 121. Each of lower rings 13 is secured to a related one of the rear legs 11. Each of the upper rings 14 is provided movably on a related one of the rear legs 11. Each of the upper rings 14 is formed with two brackets 141. The brackets 141 are separated from each other by the right angle.

The front leg rod unit 20 includes two front legs 21, two caps 12, two lower rings 13 and two upper rings 22. The front legs 21 are in the form of a cylinder. Each of the caps 12 is secured to a lower end of a related one of the front legs 21. Each of the caps 12 is formed with a bracket 121. Each of lower rings 13 is provided around and secured to a related one of the front legs 21. Each of the upper rings 22 is provided movably on a related one of the front legs 21. Each of the upper rings 22 includes two brackets 221 extended from the periphery and a sheath 222 extended longitudinally from a lower end. The brackets 221 are separated from each other by the right angle.

Each of the front and rear linking units includes two rods 30 pivotally connected to each other with a pin 301 so that each of the front and rear linking units is movable between an extended position and a collapsed position. With a pin 302, a lower end of each of the rods 30 of the rear linking unit is pivotally connected to the bracket 121 of a related one of the caps 12 of the rear leg unit 10. With another pin 302, an upper end of each of the rods 30 of the rear linking unit is pivotally connected to a related one of the brackets 141 of a related one of the upper rings 14.

With another pin 302, a lower end of each of the rods 30 of the front linking unit is pivotally connected to the bracket 121 of a related one of the caps 12 of the front leg unit 20. With another pin 302, an upper end of each of the rods 30 of the front linking unit is pivotally connected to a related one of the brackets 221 of a related one of the upper rings 22.

Each of the lateral linking units includes two rods 40 pivotally connected to each other with a pin 401 so that each of the lateral linking units is movable between an extended position and a collapsed position. With a pin 402, a lower end of the first rod 40 is pivotally connected to the bracket 131 of the lower ring 13 provided on a related one of the rear legs 11.

With another pin 402, an upper end of the first rod 40 is pivotally connected to a related one of the brackets 221 of the upper ring 22 provided on a related one of the front legs 21.

With another pin 402, a lower end of the second rod 40 is pivotally connected to the bracket 131 of the lower ring 13 provided on a related one of the front legs 21. With another pin 402, an upper end of the second rod 40 is pivotally connected to a related one of the brackets 141 of the upper ring 14 provided on a related one of the rear legs 11.

The movable armrest unit 50 includes two beams 51, two rings 52 and two caps 512. Each of the rings 52 is movably provided on a related one of the rear legs 11. At an end of each of the beams 51, there is a protrusion 511 pivotally connected to a bracket formed on a related one of the rings 52. Each of the caps 512 is secured to or formed at another end of a related one of the beams 51. Each of the caps 512 receives an upper end of a related one of the front legs 21 when the collapsible chair frame is in the extended position. Each of the caps 512 is formed with a clip 514 for clipping a related one of the rear legs 11 when the collapsible chair frame is in the collapsed position.

In the extended position of the collapsible chair frame, the rear legs 11 and the front legs 21 are pulled outward. The rings 52 are provided on the rear rod 11 while the caps 512 are provided on the front legs 21. Four corners of the mat are connected to the rear legs 11 and two other corners of the mat are connected to the front legs 21.

In the collapsed position of the collapsible chair frame, the caps 512 are removed from the front legs 21 and then the beams 51 are pivoted downward so that the clips 514 clip and the rear legs 11. Then, the front legs 21 and the rear legs 11 are moved inward together. Since the lower rings 13 are not movable, the upper rings 14 and 22 are lifted and the linking units are turned into I-shape from X-shape.

The rods 30 of extend longer than the rods 40. Therefore, the width of the collapsible chair frame taken in a front or rear view is larger than the width of the collapsible chair frame taken in a lateral view for ergonomic purposes. To compensate the difference between the rods 30 and 40, the lower ends of the rods 30 are located lower than the lower ends of the rods 40. That is, the caps 12 are located lower than the lower rings 13.

The rear legs 11 extend longer than the front legs 21. An upper section of each of the rear legs 11 is used as a bone for the backrest. In the collapsed position of the collapsible chair frame, the rings 14 are still located on the rear legs 11 near the upper ends of the rear legs 11. By now, the rings 22 have been raised beyond the front legs 21. However, the sheaths 222 still receive the upper ends of the front legs 21 and retain the rings 22 connected to the front legs 21. Accordingly, the upper ends of all of the rods 30 and the upper ends of two of the rods 40 are still connected to the front legs 21. Therefore, the sheaths 222 compensate the difference between the front legs 21 and the rear legs 11.

Figure 6:
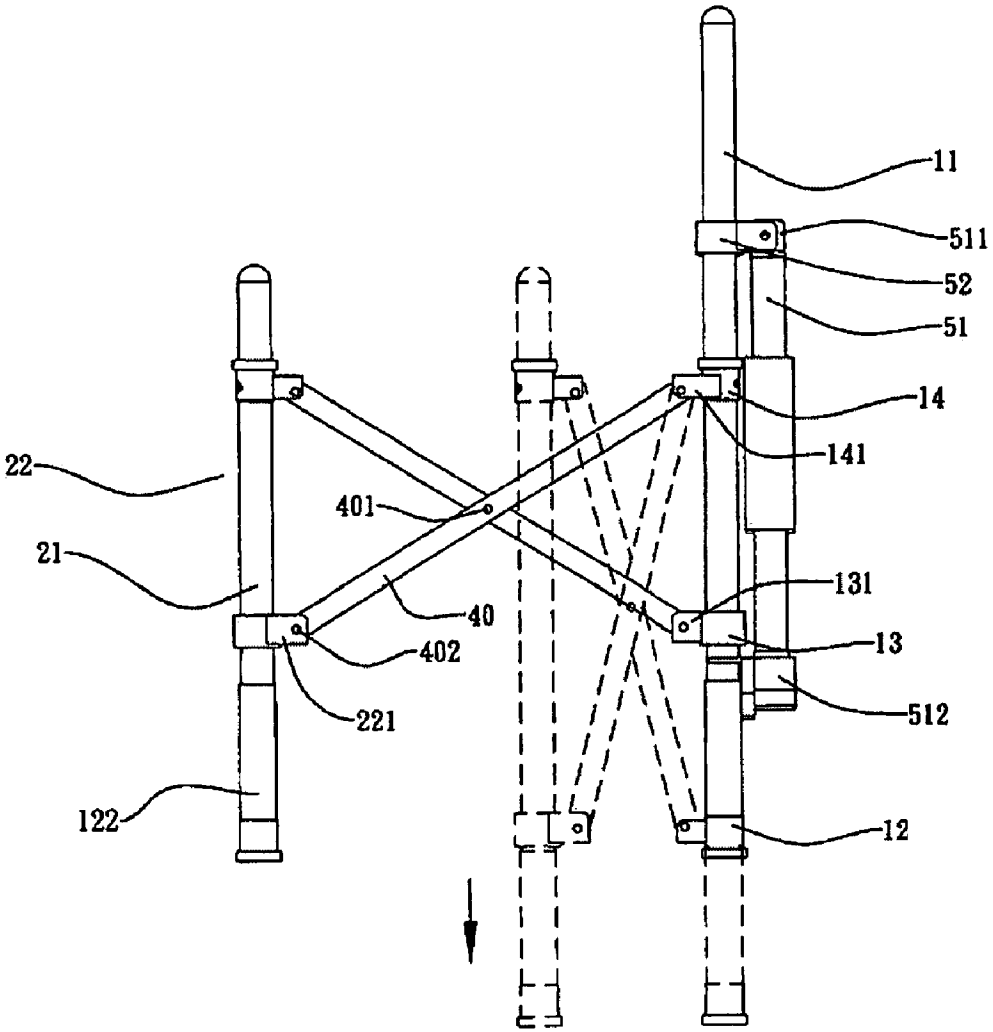
FIG. 6 is a side view of a collapsible chair frame according to the second embodiment of the present invention.

Referring to FIG. 6, a collapsible chair frame according to a second embodiment of the present invention is shown. The second embodiment is identical to the first embodiment except a few things. Firstly, the upper rings 14 and 22 are secured to the rear legs 11 and the front legs 21, respectively. Secondly, the caps 12 and the lower rings 13 are movable relative to the legs 11 and 21. Thirdly, each of the caps 12 is formed with a sheath 122 for receiving the lower end of a related one of the legs 11 and 21. Fourthly, the sheaths 222 are omitted.

Figure 7:
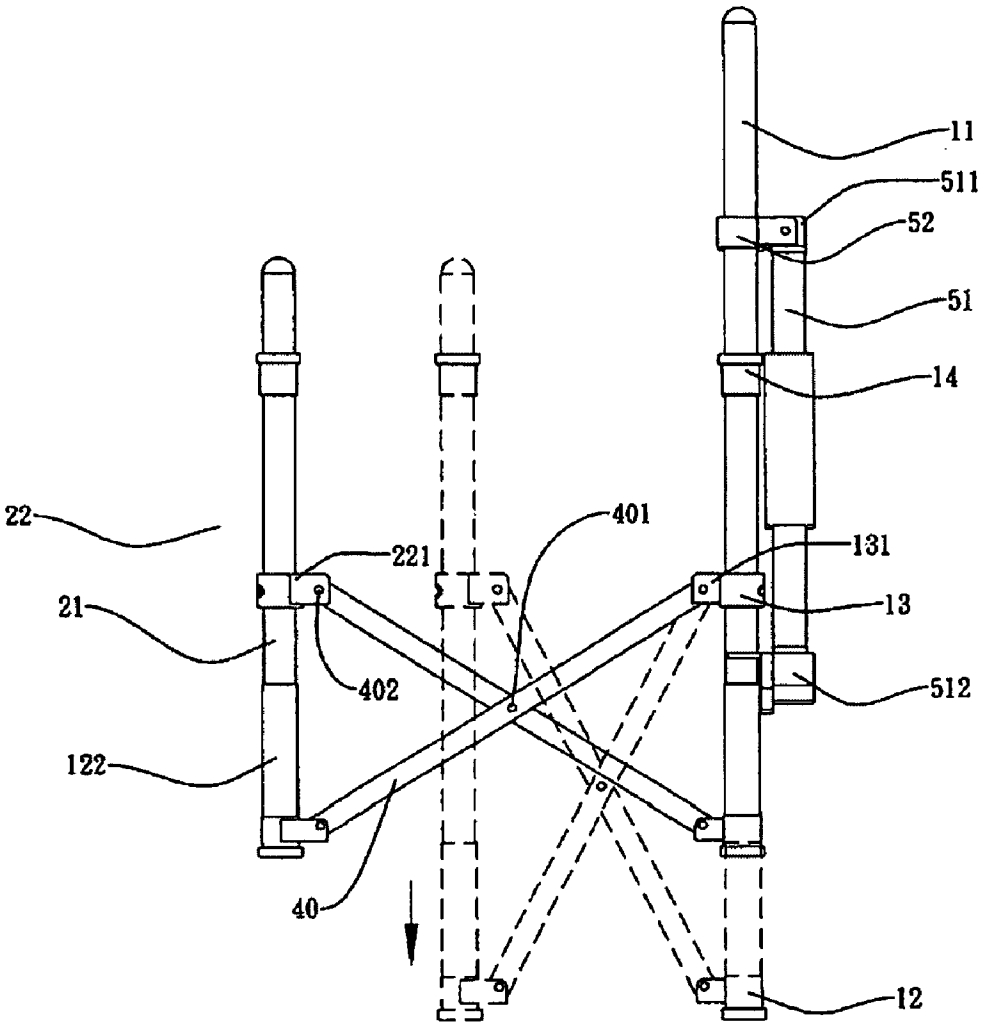
FIG. 7 is a side view of a collapsible chair frame according to the third preferred embodiment according to the present invention.

Referring to FIG. 7, a collapsible chair frame according to a third embodiment of the present invention is shown. The third embodiment is identical to the second embodiment except a few things. Firstly, the upper end of each of the rods 40 is pivotally connected to a related one of the lower rings 13 instead of one of the upper rings 14. Secondly, the lower end of each of the rods 40 is pivotally connected to a related one of the caps 12 instead of one of the lower rings 13.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A collapsible chair frame comprising:

two rear legs;

two front legs extending shorter than the rear legs;

four caps each secured to a lower end of a related one of the legs;

four sheaths each extended from a related one of the caps and used to continue to receive the related leg when the related cap is lowered beyond the related leg in a collapsed position of the collapsible chair frame;

four lower rings each movably provided on a related one of the legs;

two rear, upper rings each secured to a related one of the rear legs;

two front, upper rings each movably provided on a related one of the front legs;

four lateral rods each comprising a lower end pivotally connected to a related one of the lower rings and an upper end pivotally connected to a related one of the upper rings;

two rear rods extending longer than the lateral rods, each of the rear rods comprising a lower end pivotally connected to a related one of the caps and an upper end pivotally connected to a related one of the rear, upper rings; and two front rods extending as long as the rear rods, each of the front rods comprising a lower end pivotally connected to a related one of the caps and an upper end pivotally connected to a related one of the front, upper rings.

2. A collapsible chair frame comprising:

two rear legs;

two front legs extending shorter than the rear legs;

four caps each secured to a lower end of a related one of the legs;

four sheaths each extended from a related one of the caps and used to continue to receive the related leg when the related cap is lowered beyond the related leg in a collapsed position of the collapsible chair frame;

four lower rings each movably provided on a related one of the legs;

two rear, upper rings each secured to a related one of the rear legs;

two front, upper rings each movably provided on a related one of the front legs;

four lateral rods each comprising a lower end pivotally connected to a related one of the caps and an upper end pivotally connected to a related one of the lower rings;

two rear rods extending longer than the lateral rods, each of the rear rods comprising a lower end pivotally connected to a related one of the caps and an upper end pivotally connected to a related one of the rear, upper rings; and two front rods extending as long as the rear rods, each of the front rods comprising a lower end pivotally connected to a related one of the caps and an upper end pivotally connected to a related one of the front, upper rings.

* * * * *